US009408005B2

(12) United States Patent
Jeppesen

(10) Patent No.: US 9,408,005 B2
(45) Date of Patent: Aug. 2, 2016

(54) HEARING AID WITH ADAPTIVE ANTENNA SYSTEM

(71) Applicant: GN ReSound A/S, Ballerup (DK)

(72) Inventor: Brian Jeppesen, Frederiksberg (DK)

(73) Assignee: GN ReSound A/S, Ballerup (DK)

( * ) Notice: Subject to any disclaimer, the term of this patent is extended or adjusted under 35 U.S.C. 154(b) by 0 days.

(21) Appl. No.: 14/204,891

(22) Filed: Mar. 11, 2014

(65) Prior Publication Data

US 2015/0131832 A1 May 14, 2015

(30) Foreign Application Priority Data

Nov. 11, 2013 (DK) ..... 2013 70663
Nov. 11, 2013 (EP) ..... 13192315

(51) Int. Cl.
*H04R 3/00* (2006.01)
*H04R 25/00* (2006.01)
(Continued)

(52) U.S. Cl.
CPC ..... *H04R 25/556* (2013.01); *H01Q 1/273* (2013.01); *H01Q 21/245* (2013.01); *H01Q 21/28* (2013.01); *H04R 2225/51* (2013.01)

(58) Field of Classification Search
CPC . H04R 2225/51; H04R 25/554; H04B 7/0404
USPC ..... 381/72, 73, 102, 103, 312–315; 343/725–729
See application file for complete search history.

(56) References Cited

U.S. PATENT DOCUMENTS 8,723,730 B2 * 5/2014 Lu ..... G01S 3/34 342/464
2007/0217637 A1 9/2007 Haenggi et al.
(Continued)

FOREIGN PATENT DOCUMENTS

EP 1455415 A1 9/2004
EP 2560233 A2 2/2013
(Continued)

OTHER PUBLICATIONS

Examination and Search Report dated Jun. 17, 2014 in Application No. PA 2013 70663 (5 pages).
(Continued)

*Primary Examiner* — Brian Ensey
*Assistant Examiner* — Julie X Dang
(74) *Attorney, Agent, or Firm* — Vista IP Law Group, LLP; Gerald Chan

(57) ABSTRACT

A hearing aid includes: a signal processor; a wireless communications unit connected to the signal processor; and an antenna system with a data terminal and at least one control terminal, wherein the data terminal is connected to the wireless communications unit, the antenna system comprising a first antenna and one or more antenna feeds including a first antenna feed, the antenna system further comprising an antenna configurator for configuring the antenna system to operate in a selected antenna mode selected from a plurality of antenna modes including a first antenna mode and a second antenna mode according to a control signal transmitted on the at least one control terminal, wherein the antenna configurator is configured to apply a first antenna configuration to the data terminal when operating in the first antenna mode, and to apply a second antenna configuration to the data terminal when operating in the second antenna mode.

13 Claims, 5 Drawing Sheets

(51) Int. Cl.

| | |
|---|---|
| ***H01Q 1/27*** | (2006.01) |
| ***H01Q 21/24*** | (2006.01) |
| ***H01Q 21/28*** | (2006.01) |

(56) References Cited

U.S. PATENT DOCUMENTS

2007/0224949 A1* 9/2007 Morton et al. ..... 455/101
2009/0315802 A1* 12/2009 Johansen ..... H01Q 13/085 343/853
2010/0054512 A1* 3/2010 Solum ..... H04R 25/554 381/315
2010/0054521 A1* 3/2010 Hung ..... G06F 1/1616 381/386
2010/0120466 A1* 5/2010 Li ..... H04B 1/006 455/552.1
2010/0195753 A1 8/2010 Yamamoto
2011/0019830 A1* 1/2011 Leibman ..... H01Q 1/273 381/60
2012/0087506 A1* 4/2012 Ozden ..... H04R 25/554 381/23.1
2013/0163798 A1* 6/2013 Ozden ..... H04R 25/554 381/315

FOREIGN PATENT DOCUMENTS

EP 2560233 A3 2/2013
EP 2608575 A2 6/2013

OTHER PUBLICATIONS

Extended European Search Report dated Apr. 17, 2014 in Application No. 13192315.3 (7 pages).

* cited by examiner

HEARING AID WITH ADAPTIVE ANTENNA SYSTEM

RELATED APPLICATION DATA

This application claims priority to and the benefit of Danish Patent Application No. PA 2013 70663 filed on Nov. 11, 2013, pending, and European Patent Application No. 13192315.3, filed on Nov. 11, 2013, pending. The entire disclosures of both of the above applications are expressly incorporated by reference herein.

FIELD

The present disclosure relates to a hearing aid configured for transmitting or receiving a wireless signal. In particular, a hearing aid with an adaptive antenna system for increasing the likelihood of properly receiving a wireless signal is disclosed.

BACKGROUND

Wireless communication to and from hearing aids has been increasing in continuation of the developments within wireless communication technology. The limited size within a hearing aid compared to e.g. a smartphone, however, strictly limits to the possibilities of antennas to be used.

SUMMARY

In order to obtain and retain a stable reception of a wireless signal, and to account for spatial differences (e.g. polarizing or field distribution) of the transmitted and/or received radio waves, differently oriented and polarized antennas may be useful.

There is a need for a hearing aid that improves wireless reception of data, regardless of the orientation of the hearing aid or the position of the user.

Despite the known solutions there is still a need for an antenna system that overcomes the limitations of a hearing aid, and yet still provides the benefits of being able to account for difference in polarization of the signal to receive.

Accordingly, a hearing aid with an adaptive configurable antenna system is provided. The hearing aid comprises a signal processor optionally for processing one or more audio signals to compensate a hearing loss of a user of the hearing aid; a wireless communications unit connected to the signal processor for wireless data communication; an antenna system with a data terminal and at least one control terminal, wherein the data terminal is connected to the wireless communications unit, the antenna system comprising a first antenna and one or more antenna feeds including a first antenna feed. The antenna system comprises an antenna configurator for configuring the antenna system to operate in a selected antenna mode selected from a plurality of antenna modes including a first antenna mode and a second antenna mode according to a control signal on the at least one control terminal, wherein the antenna configurator is configured to apply a first antenna configuration to the data terminal when operating in the first antenna mode, and to apply a second antenna configuration to the data terminal when operating in the second antenna mode.

Also disclosed is a method for operating a hearing aid, the hearing aid comprising an antenna system with a data terminal for data communication. The method comprises receiving a first parameter, e.g. indicating signal quality in a first antenna mode of the antenna system; optionally receiving a second parameter, e.g. indicating signal quality in a second antenna mode of the antenna system; determining an optimum antenna mode based on the first and/or second parameters; and configuring the antenna system to operate in the optimum antenna mode. Configuring the antenna system comprises sending or applying a control signal to the antenna system.

Also disclosed herein is a method for operating a hearing aid, wherein the hearing aid comprises an antenna system with a data terminal for data communication. The method comprises configuring the antenna system to operate in a first antenna mode if the hearing aid is in a transmitting state and configuring the antenna system to operate in a second mode if the hearing aid is in a receiving state. Configuring the antenna system comprises sending or applying a control signal to the antenna system.

According to one or more embodiments, a hearing aid and a method for operating a hearing aid to improve the reception of an electromagnetic signal is provided.

A hearing aid includes: a signal processor for processing one or more audio signals to compensate a hearing loss of a user of the hearing aid; a wireless communications unit connected to the signal processor for wireless data communication; and an antenna system with a data terminal and at least one control terminal, wherein the data terminal is connected to the wireless communications unit, the antenna system comprising a first antenna and one or more antenna feeds including a first antenna feed; wherein the antenna system further comprises an antenna configurator for configuring the antenna system to operate in a selected antenna mode selected from a plurality of antenna modes including a first antenna mode and a second antenna mode according to a control signal transmitted on the at least one control terminal, wherein the antenna configurator is configured to apply a first antenna configuration to the data terminal when operating in the first antenna mode, and to apply a second antenna configuration to the data terminal when operating in the second antenna mode.

Optionally, the one or more antenna feeds further comprises a second antenna feed, the first antenna feed is connected to the first antenna at a first position, and the second antenna feed is connected to the first antenna at a second position.

Optionally, the first antenna feed is connected to the first antenna at a first position, and wherein the antenna system comprises a second antenna and a second antenna feed is connected to the second antenna at a second position.

Optionally, the data terminal is connected to the first antenna feed in the first antenna mode, and the data terminal is connected to the second antenna feed in the second antenna mode.

Optionally, the antenna configurator in the first antenna mode applies a first primary impedance to the first antenna feed and a second primary impedance to the second antenna feed, and wherein the antenna configurator in the second antenna mode applies a first secondary impedance to the first antenna feed and a second secondary impedance to the second antenna feed.

Optionally, the signal processor is configured to select the antenna mode and transmit the control signal to the antenna system to operate the antenna system in the selected antenna mode.

Optionally, the first antenna configuration has a first radiation pattern, and wherein the second antenna configuration has a second radiation pattern different from the first radiation pattern.

Optionally, the first antenna configuration has a first polarization, and wherein the second antenna configuration has a second polarization different from the first polarization.

Optionally, the first antenna configuration comprises an antenna section extending in a first direction, and wherein the second antenna configuration comprises an antenna section extending in a second direction substantially perpendicular to the first direction.

Optionally, the first antenna configuration is configured for frequencies in the range of 2.4-2.5 GHz.

A method for operating a hearing aid comprising an antenna system with a data terminal for data communication, the method includes: receiving a first parameter indicating a signal quality in a first antenna mode of the antenna system; receiving a second parameter indicating a signal quality in a second antenna mode of the antenna system; selecting an antenna mode from at least the first antenna mode and the second antenna mode based on the first and second parameters; and configuring the antenna system to operate in the selected antenna mode.

Optionally, the act of configuring the antenna system comprises: applying a first antenna configuration to the data terminal of the antenna system when the first antenna mode is the selected antenna mode; or applying a second antenna configuration to the data terminal of the antenna system when the second antenna mode is the selected antenna mode.

Optionally, act of configuring the antenna system comprises: applying a first primary impedance to a first antenna feed of the antenna system, and a second primary impedance to a second antenna feed of the antenna system, when the first antenna mode is the selected antenna mode; or applying a first secondary impedance to the first antenna feed of the antenna system, and a second secondary impedance to the second antenna feed of the antenna system, when the second antenna mode is the selected antenna mode.

Optionally, the acts of receiving, the act of selecting, and the act of configuring are performed by a signal processor external to the antenna system, and wherein the method further comprises transmitting a control signal from the processor to the antenna system to configure the antenna system.

Optionally, the first parameter is indicative of a received signal strength associated with the first antenna mode, and/or the second parameter is indicative of a received signal strength associated with the second antenna mode.

Other aspects and features will be evident from reading the following detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
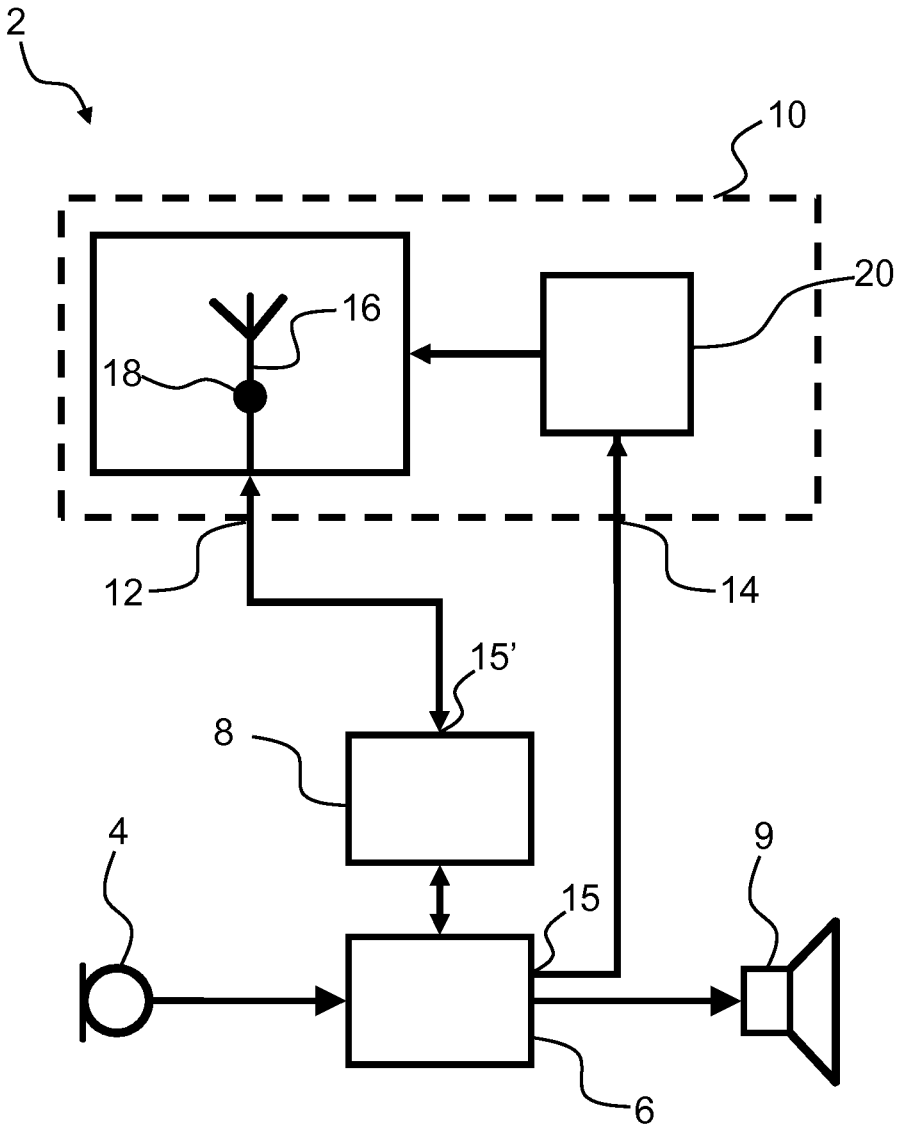
FIG. 1 schematically illustrates an exemplary hearing aid with an antenna system, FIG. 2 schematically illustrates an exemplary hearing aid with an antenna system, FIG. 3 schematically illustrates an exemplary antenna system for a hearing aid, with one antenna and one feeding point FIG. 4 schematically illustrates an exemplary antenna system for a hearing aid, with two antennas and two feeding points FIG. 5 schematically illustrates an exemplary antenna system for a hearing aid, with one antenna and two feeding points FIG. 6 schematically illustrates an exemplary antenna system for a hearing aid, with one antenna and two feeding points FIG. 7 flow diagram illustrating a method for operating an antenna system for a hearing aid.

Various embodiments are described hereinafter with reference to the figures, in which exemplary embodiments are shown. The claimed invention may, however, be embodied in different forms and should not be construed as being limited to the embodiments set forth herein. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The present disclosure relates to a hearing aid with an antenna system. The antenna system comprises a data terminal and at least one control terminal. The antenna system may comprise a first antenna and one or more antenna feeds, including a first antenna feed. Further, the antenna system may comprise an antenna configurator for configuring the antenna system to operate in a selected antenna mode. The antenna mode may be selected from a plurality of antenna modes including a first antenna mode and a second antenna mode.

The configuration of the antenna system may be applied according to a control signal on the at least one control terminal. The antenna configurator may be configured to apply a first antenna configuration to the data terminal when operating in the first antenna mode, and to apply a second antenna configuration to the data terminal when operating in the second antenna mode.

The hearing aid may comprise a processing unit including a signal processor for processing one or more audio signals to compensate for hearing loss or disability of the hearing device user.

The hearing aid comprises a wireless communications unit connected to the signal processor for wireless data communication. The wireless communications unit may be connected to the data terminal of the antenna system.

An antenna configuration may involve the size, shape, type and location of the antenna and antenna segments along with the location of an antenna feed.

Provision of an adaptive antenna system by choosing or selecting between a number of different antenna configurations, enhances possibilities for receiving a desired signal, and/or enhances the quality of the received signal. The polarization and/or radiation pattern of a transmitted signal may not be suited for reception by a specific antenna configuration due to the placement and orientation of the antenna and respective antenna feeds of the receiving antenna system. The polarization and/or radiation pattern of an antenna configuration may be referred to as antenna characteristics.

A hearing aid, as disclosed, with an antenna system comprising an antenna configurator, enable a hearing aid to reduce discrepancies between antenna configuration characteristics of the transmitting antenna system and the receiving antenna system.

A further advantage of a configurable antenna system may be that one antenna configuration may be suitable for a hearing aid being worn on a right ear of a user, while another antenna configuration may be suitable for a hearing aid being worn on a left ear of a user. Incorporating several antenna configurations in an antenna system for a hearing aid, may enable the same hearing aid to be used for left and right ears, thus reducing production costs.

An antenna configurator of a receiving antenna system may be able to apply different antenna modes comprising antenna configurations with different antenna characteristics, thereby altering the characteristics of a receiving and/or transmitting antenna system, hence improving reception and/or transmission of a signal with a radiation pattern and/or polarization not suited for reception by other antenna configurations.

Similarly, an antenna configurator of a transmitting antenna system may be able to apply different antenna modes comprising antenna configuration with different antenna characteristics, thereby altering the characteristics of the transmitting antenna system.

The characteristics of an antenna may be determined by several factors, among others the shape and location of the actual antenna, as well as the antenna feed feeding or receiving the signal. The term "characteristics of an antenna" may thus refer to a state of combination of properties such as the properties of the physical antenna, the one or more antenna feeds, and the characteristics, such as impedance, applied to the antenna feed.

The first antenna configuration may have a first radiation pattern, e.g. with a first main lobe in a first direction. The second antenna configuration may have a second radiation pattern, e.g. with a second main lobe in a second direction. The second radiation pattern may be different from the first radiation pattern. The angle between the first and second direction may be in the range from 45° to 135°.

The first antenna configuration may have a first polarization. A second antenna configuration may have a second polarization. The second polarization may be different from the first polarization. The first polarization and/or the second polarization may be a transverse magnetic polarization.

The antenna configurator may alter the antenna configuration by altering the physical properties, such as geometry or location, of the antenna. Thus, a first antenna mode may comprise a first antenna configuration comprising an antenna section extending in a first direction and/or along a first axis, and the second antenna mode may comprise an antenna section extending in a second direction and/or along a second axis.

The second direction may be substantially perpendicular to the first direction (for example, the second direction and the first direction may be 90°±10° with respect to each other). Thereby obtaining radiation patterns that compensates each other, i.e. the second antenna configuration may be able to receive a signal that is weakly received by the first antenna configuration. This situation is especially true if the weak reception is due to discrepancy of radiation patterns between the transmitting antenna and the radiation pattern of the first antenna configuration.

Alternatively or additionally, the antenna configurator may select an antenna mode and alter the antenna system characteristics by utilizing different antenna feeds and/or apply different properties to different antenna feeds.

An antenna feed may be a one-terminal antenna feed or a two-terminal antenna feed. For a one-terminal antenna feed, e.g. used for a monopole antenna, the first antenna terminal may be connected to one or more antenna segments. For a two-terminal antenna feed, e.g. used for a dipole antenna, the first antenna terminal is connected to a first antenna segment and the second antenna terminal is connected to a second antenna segment.

In an exemplary antenna system, the first antenna feed may be connected to the first antenna at a first position, and a second antenna feed may be connected to the first antenna at a second position. Accordingly, an antenna of the antenna system may incorporate one or more antenna feeds connected to the antenna configurator. Thus, the antenna configurator may change the antenna mode by utilizing the first second antenna feed and/or a second antenna feed. Alternatively or additionally, the antenna configurator may apply suitable properties to the antenna feed(s) not utilized for receiving or transmitting, i.e. not connected to the data terminal in that particular antenna mode. The antenna configurator may decouple one or more antenna feeds in an antenna mode, e.g. in practice by applying a very large impedance, such as at least 1 kOhm, such as at least 10 kOhm, e.g. at least 100 kOhm, to the first and/or the second antenna terminal depending on the selected antenna mode. For a two-terminal antenna feed, the antenna configurator may short-circuit the first antenna terminal and the second antenna terminal of one or more antenna feeds in an antenna mode, e.g. for coupling two antenna segments of an antenna. For a two-terminal antenna feed, the antenna configurator may impedance match the first antenna terminal and the second antenna terminal of one or more antenna feeds in an antenna mode, e.g. for coupling two antenna segments of an antenna.

The situation of utilizing a single antenna and several antenna feeds for the antenna is especially useful in a small hearing aid, where size is limited, and all components are desirably as small as possible.

The antenna configurator may in a first antenna mode apply a first primary impedance to the first antenna feed and a second primary impedance to the second antenna feed. The antenna configurator may in a second antenna mode apply a first secondary impedance to the first antenna feed and a second secondary impedance to the second antenna feed.

In an exemplary antenna system, the antenna system may comprise a plurality of antennas including a first antenna and a second antenna. Hence, the first antenna feed may be connected to the first antenna at a first position, and the antenna system may comprise a second antenna and a second antenna feed. The second antenna feed may be connected to the second antenna at a second position. In this exemplary antenna system, the antenna configurator may choose to use either the first antenna or the second antenna.

The first antenna feed may be positioned at a first end of the first antenna. The second antenna feed may be positioned at a second end of the first antenna or at a first end of a second antenna. Antenna feeds may be positioned between respective ends of antennas.

Whether incorporating a single antenna with several antenna feeds or several antennas each with one or more antenna feeds, the antenna configurator may utilize a certain antenna mode by connecting the data terminal to a certain antenna configuration. Hence, the data terminal may be connected to the first antenna feed in the first antenna mode, and the data terminal may be connected to the second antenna feed in the second antenna mode in order to apply first and second antenna configurations, respectively.

The antenna configurator may control a switch circuit that connects the data terminal to the first antenna feed in a first antenna mode, and connects the data terminal to the second antenna feed in a second antenna mode. The antenna configurator may comprise a switch circuit, thus the antenna configurator is adapted for connecting the data terminal to the first antenna feed in a first antenna mode, and connecting the data terminal to the second antenna feed in a second antenna mode.

Incorporating the switch circuit into the antenna configurator may be beneficial, since the antenna configurator may apply different properties to each of the antenna feeds in accordance with the antenna mode to be utilized.

The antenna configurator may comprise a circuit for adjusting impedance of an antenna feed. The circuit may be configured to match or adjust an impedance of the antenna feed with an impedance of the wireless communication unit.

Selection of the antenna mode may be implemented in a processing unit including a signal processor. The signal processor may be configured to select the antenna mode and transmit the control signal to the antenna system to operate the antenna system in the selected antenna mode. The control signal may be sent to the antenna configurator of the antenna system. The selection of the antenna mode may be performed by the signal processor based on analysis of the received signal and determining, based on parameters such as signal strength, error rate or alike, if a change of antenna mode may be beneficial. The processing unit may receive signal quality indicator(s) from the wireless communication unit and base the selection of antenna mode/antenna configuration on the signal quality indicator(s).

If the signal processor decides if changing antenna mode may be beneficial, a control signal may be transmitted to the antenna configurator of the antenna system to reconfigure the antenna configuration to a second antenna mode with a second antenna configuration.

The antenna system may have a default antenna mode, the antenna mode previously employed may be the default.

The signal processor may configure the antenna system to utilize a second antenna mode if an indicating parameter drops below a certain threshold. Such indicating parameter may be any one or several of parameters such as signal strength, signal quality, signal to noise ratio, error rate etc. In an exemplary hearing aid, the processing unit may configure the antenna system to apply a first antenna configuration during reception and to apply a second antenna configuration during transmission of wireless signals. This is particularly useful, e.g. in a binaural hearing device, where a first hearing aid transmits to a second hearing aid, and receives from an external wireless transmitter, e.g. in a movie theatre or in an airport.

In an exemplary hearing aid, the first antenna configuration may be a default employed antenna configuration. The antenna configurator, and/or the signal processor, may thus be configured to only change the antenna configuration, if the default antenna configuration fails to properly receive the signal. Determining if the signal is received properly may be determined from any one or several of parameters such as signal strength, signal quality, signal to noise ratio, error rate etc.

The first antenna configuration and/or the second antenna configuration may be configured for frequencies in the range of 2.4-2.5 GHz, and/or in the range from 800 MHz to 1 GHz, and/or in the range from 13 MHz to 14 MHz, and/or in the range from 3.6 GHz to 3.7 GHz and/or in the range from 4.9 GHz to 5.9 GHz. The location of the antenna feed along with the size and shape of the antenna and antenna segments thereof may decide which frequencies the antenna may be best suited to receive.

Any antenna configuration, e.g. the first antenna configuration and/or the second antenna configuration, may comprise any known type of antenna, e.g. monopole antenna, dipole antenna, loop antenna or alike.

The methods disclosed herein provides improved wireless communication internally between hearing aids and external transmitters/receivers.

The first and/or the second parameter may be indicative of received signal strength, or signal strength, signal quality, signal to noise ratio, error rate etc. The first parameter may be indicative of operating state of the hearing device. The first parameter and/or the second parameter may indicate whether the hearing aid and thus the wireless communication unit is in a transmitting state or in a receiving state.

The method may be performed by a signal processor external to the antenna system. The signal processor may transmit a control signal to the antenna system to configure the antenna system. Thus the antenna system may comprise control terminal(s) connected to respective control terminal(s) of the processing unit including the signal processor.

Configuring the antenna system may comprise applying a first antenna configuration to a data terminal of the antenna system when the first antenna mode is the optimum antenna mode. The determination of whether the first antenna mode is the optimum antenna mode may be performed by a signal processor analyzing the received signal and/or operating states of the hearing aid. Similarly configuring the antenna system may comprise applying a second antenna configuration to the data terminal when the second antenna mode is the optimum antenna mode. Thereby, the method may change between different antenna modes comprising different antenna configurations, thus employing the antenna mode which is the optimum antenna mode.

The optimum antenna mode may be decided upon reception of the signal by each of the available antenna modes, and subsequently deciding which of the antenna modes is best. The desired or best antenna mode may be decided based on any one or several of parameters such as operating state of the hearing aid, signal strength, signal quality, signal to noise ratio, error rate etc.

The optimum antenna mode may also, or alternatively, be the antenna mode presently employed, or a default antenna mode, and configuring of the antenna system to utilize a different antenna mode may be performed if an indicating parameter drops below a certain threshold. Such indicating parameter may be any one or several of parameters such as signal strength, signal quality, signal to noise ratio, error rate etc.

Configuring the antenna system may comprise applying a first primary impedance to a first antenna feed, e.g. a first antenna terminal of the first antenna feed, of the antenna system, and a second primary impedance to a second antenna feed, e.g. a first antenna terminal of the second antenna feed, of the antenna system, when the first antenna mode is the optimum antenna mode. In an exemplary method, the second primary impedance may be a high impedance, such as at least 1 kOhm, such as at least 10 kOhm, e.g. at least 100 kOhm, in order to decouple the second antenna feed. The first primary impedance may be selected to be low, e.g. lower than 100 ohm, lower than 75 ohm, lower than 55 ohm. The first primary impedance may be matched according to the wireless communications unit and the first antenna feed may be coupled to the data terminal.

The method may comprise applying a first secondary impedance to the first antenna feed and a second secondary impedance to the second antenna feed when the second antenna mode is the optimum antenna mode. The first secondary impedance may be the same as the second primary impedance. The second secondary impedance may be the same as the first primary impedance. In an exemplary method the first secondary impedance may be a high impedance, such as at least 1 kOhm, such as at least 10 kOhm, e.g. at least 100 kOhm, in order to decouple the first antenna feed. The second secondary impedance may be selected to be low, e.g. lower than 100 ohm, lower than 75 ohm, lower than 55 ohm. The second secondary impedance may be matched according to the wireless communications unit and the second antenna feed may be coupled to the data terminal.

FIG. 1 shows an exemplary hearing aid 2 comprising a microphone 4 for reception of sound and conversion of the received sound into a first audio signal. The audio signal is transmitted to a signal processor 6 for optionally processing the first audio signal to compensate a hearing loss of a user of the hearing aid 2. The hearing aid 2 further comprises a wireless communications unit 8 connected to the signal processor 6 for wireless data communications. In a receiving mode, the wireless communications unit 8 feeds a second audio signal to the signal processor for processing the second audio signal to compensate a hearing loss of a user of the hearing aid 2. The signal processor 6 outputs the processed signal to a receiver or receiver assembly 9 for conversion of the processed signal into sound. The processed signal may be based on the first audio signal and/or the second audio signal, e.g. depending on a mode of operation. Further, the hearing aid 2 comprises an antenna system 10 with a data terminal 12 and at least one control terminal 14. The data terminal 12 is connected to a data terminal 15' of the wireless communications unit 8 for receiving and/or transmitting wireless signals via the antenna system. The at least one control terminal 14 is connected to a control terminal 15 of the signal processor. The antenna system 10 comprises a first antenna 16 and one or more antenna feeds including a first antenna feed 18. The antenna system 10 further comprises an antenna configurator 20 for configuring the antenna system to operate in a selected or optimum antenna mode, e.g. depending on a control signal on the at least one control terminal 14. The antenna mode may be selected from a plurality of antenna modes including a first antenna mode and a second antenna mode according to a control signal on the at least one control terminal 14. The antenna configurator 20 may be configured to apply a first antenna configuration to the data terminal 12 when operating in the first antenna mode, and to apply a second antenna configuration to the data terminal 12 when operating in the second antenna mode.

The signal processor 6 may be connected to the at least one control terminal 14, i.e. the control signal applied to the at least one control terminal 14 may be transmitted from signal processor 6. In other exemplary hearing aids, the wireless communications unit 8 may be connected to the at least one control terminal 14, i.e. the control signal applied to the at least one control terminal 14 may be transmitted from the wireless communications unit 8.

The first antenna may possess several different characteristics as will be described in relation to FIGS. 3-5

Figure 2:
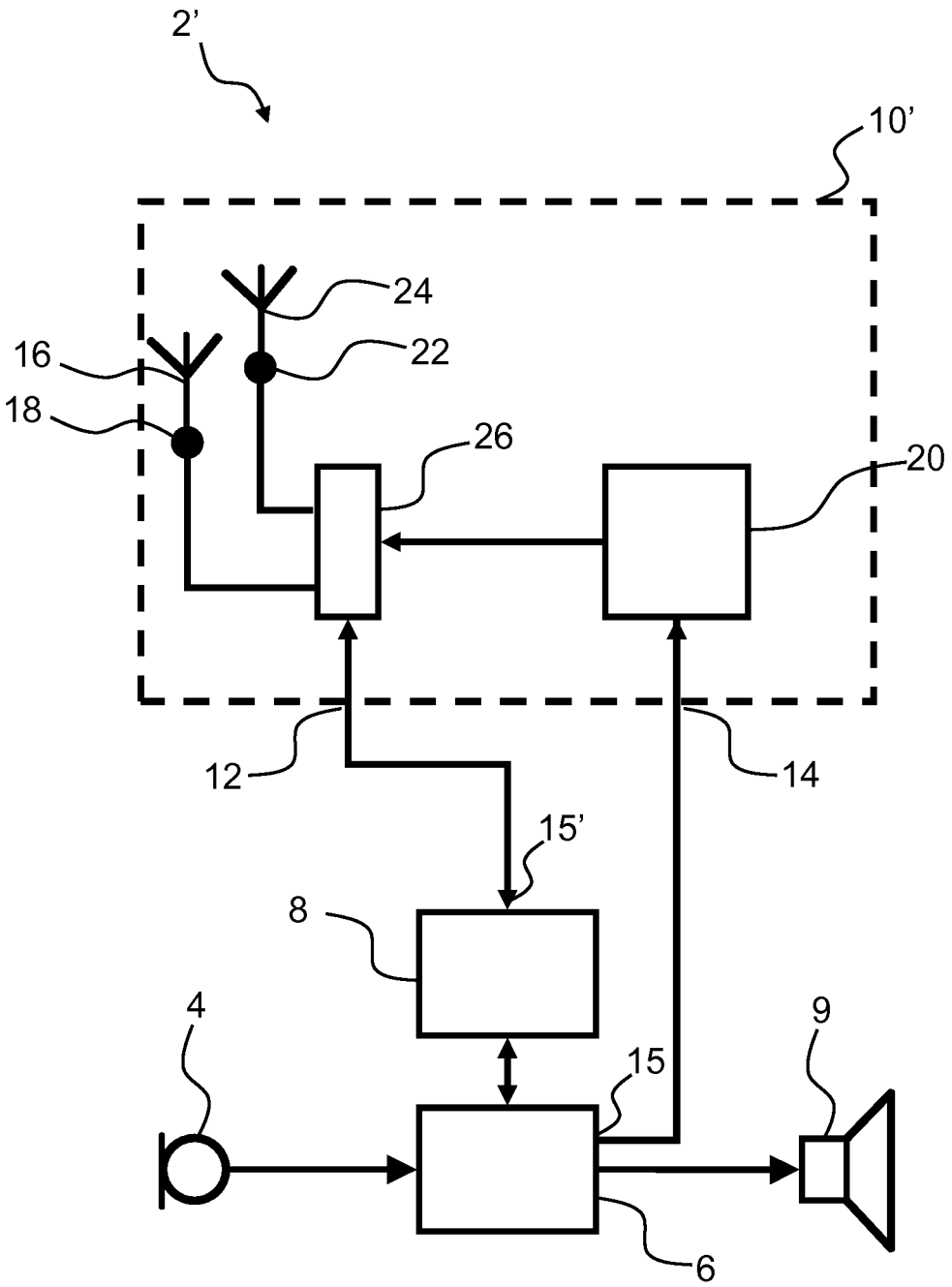

FIG. 2 illustrates an exemplary hearing aid 2', wherein the antenna system 10' further comprises a second antenna 24, a second antenna feed 22, and an antenna switch 26. The antenna switch 26 is controlled by the antenna configurator 20. In some exemplary antenna systems the switch 26 may be an integrated part of the antenna configurator 20. The antenna switch 26 connects the data terminal 12 to the first antenna feed 18 or to the second antenna feed 22 according to the control of the antenna configurator 20. The first antenna 16 and the second antenna 24 may be positioned and oriented relative to each other to achieve reception and transmission of signals with different polarization and/or radiation patterns.

Figure 3:
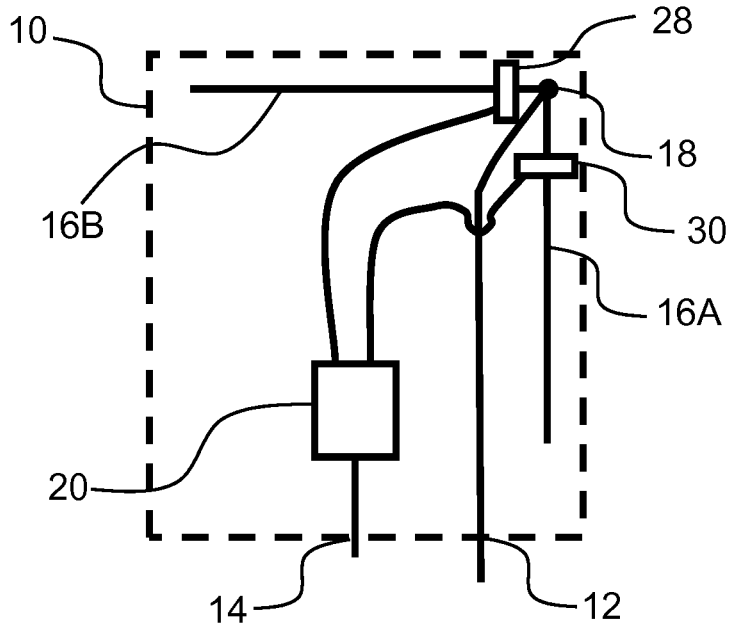

FIG. 3 illustrates an exemplary antenna system 10 for a hearing aid 2. The exemplary antenna system 10 illustrated in FIG. 3 comprises a first antenna 16, with a first antenna feed 18. The first antenna 16 may comprise a first primary antenna section 16A and a first secondary antenna section 16B. A first breaker 28 and a second breaker 30 enable or provide for adapting or changing of the properties of the first antenna 16. By enabling the first breaker 28 and disabling the second breaker 30, a first antenna configuration for a first antenna mode is enabled. Thus the first antenna configuration comprises the first antenna feed 18 and the first primary antenna section 16A. Conversely, by enabling the second breaker 30 and disabling the first breaker 28 a second antenna configuration for a second antenna mode is enabled. Thus, the second antenna configuration comprises the first antenna feed 18 and the first secondary antenna section 16B. The enabling and disabling of first and second breakers 28, 30 are controlled by the antenna configurator 20. Input of whether to use the first antenna configuration or the second antenna configuration is received from the control terminal 14 by the antenna configurator 20. In the illustrated exemplary antenna system 10 of FIG. 3, the data terminal 12 is constantly connected to the first antenna feed 18, since the antenna configuration is changed by changing the characteristics of the first antenna 16, by means of breakers 28, 30. In other exemplary antenna systems, the data terminal may be connected to an antenna switch 26 or the antenna configurator 20.

In an exemplary antenna system 10, the first secondary antenna section 16 B may be extending from the first antenna feed 18 substantially perpendicular to the first primary antenna section 16A. Thus, the first antenna configuration has different antenna characteristics compared to antenna characteristics of the second antenna mode.

Figure 4:
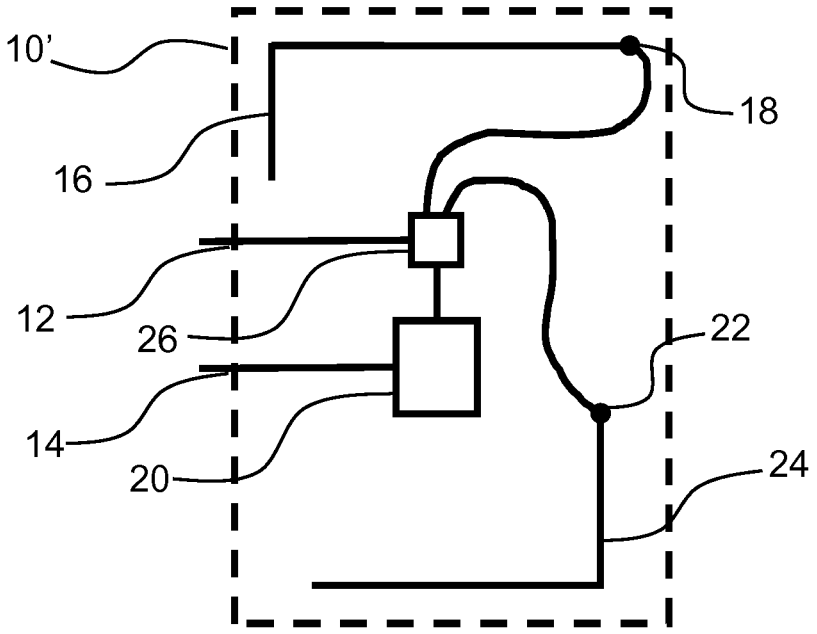

FIG. 4 illustrates an exemplary antenna system 10' for a hearing aid. The antenna system 10' comprise a first antenna 16 with a first antenna feed 18, and a second antenna 24 with a second antenna feed 22. The antenna switch 26 may connect the data terminal 12 to the first antenna feed 18 in a first antenna mode, and the antenna switch 26 may connect the data terminal 12 to the second antenna feed 22 in a second antenna mode. Input of whether to use the first antenna mode or the second antenna mode is received from the control terminal 14 by the antenna configurator 20, which controls the antenna switch 26 according to the received control signal.

The first antenna 16 and the second antenna 24 may be shaped and positioned in relation to each other such that the antenna system 10', in a first antenna configuration comprising the first antenna 16, has a first radiation pattern, and wherein the antenna system 10', in a second antenna mode comprising the second antenna 24, has a second radiation pattern. The first radiation pattern may be different from the second radiation pattern, thus enabling a high degree of reception and transmission diversity of the antenna system 10'.

Similarly, the first antenna 16 and the second antenna 24 may be shaped and positioned in relation to each other such that the antenna system 10', in a first antenna configuration comprising the first antenna 16, has a first polarization, and wherein the antenna system 10', in a second antenna configuration comprising the second antenna 24, has a second polarization. The first polarization may be different from the second polarization, thus enabling a high degree of reception and transmission diversity of the antenna system 10'.

In an exemplary antenna system 10', the first antenna 16 may extend from the first antenna feed 18 in a direction substantially perpendicular to the extension of the second antenna 24 from the second antenna feed 22.

Figure 5:
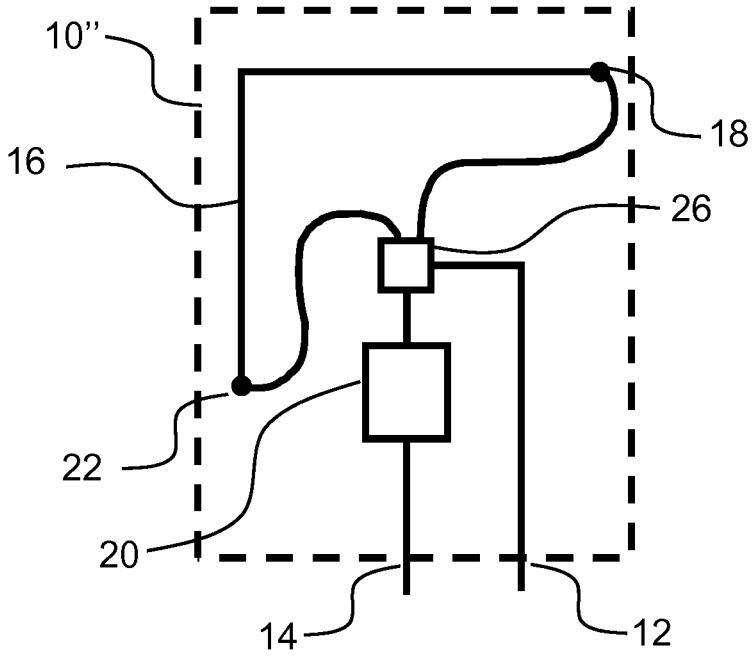

FIG. 5 illustrates an exemplary antenna system 10" for a hearing aid 2, 2". The antenna system 10" comprises a first antenna 16 with a first antenna feed 18 and a second antenna feed 22. The first antenna feed 18 may be connected to a first position of the first antenna 16, and the second antenna feed 22 may be connected to a second position of the antenna 16. The antenna switch 26 may connect the data terminal 12 to the first antenna feed 18 in a first antenna mode, and the antenna switch 26 may connect the data terminal 12 to the second antenna feed 22 in a second antenna mode. Input of whether to use the first antenna mode or the second antenna mode is received from the control terminal 14 by the antenna configurator 20, which controls the antenna switch 26 according to the received control signal.

In an exemplary antenna system 10", the first antenna 16 may be extending from the first antenna feed 18 substantially perpendicular to the extension of the first antenna 16 from the second antenna feed 22. Thus, the first antenna configuration exhibits different antenna characteristics compared to antenna characteristics of the second antenna configuration.

The antenna configurator 20 may control the impedance of the first antenna feed 18 and the impedance of the second antenna feed 22. Thus, in a first antenna mode with a first antenna configuration, the impedance of the first antenna feed 18 may be set to a first primary impedance, and the impedance of the second antenna feed 22 may be set to a second primary impedance. In a second antenna mode with a second antenna configuration, the impedance of the first antenna feed 18 may be set to a first secondary impedance, and the impedance of the second antenna feed 22 may be set to a second secondary impedance.

In an exemplary antenna system 10", the first primary impedance may be low compared to the second primary impedance, and the first secondary impedance may be high compared to the second secondary impedance.

In an exemplary antenna system 10", the second primary impedance and/or the first secondary impedance may be very high or infinitely high, e.g. above 1 MΩ.

The antenna configurator 20 may control the impedance of the first antenna feed 18 and the impedance of the second antenna feed 22, via a control signal to the antenna switch 26.

Figure 6:
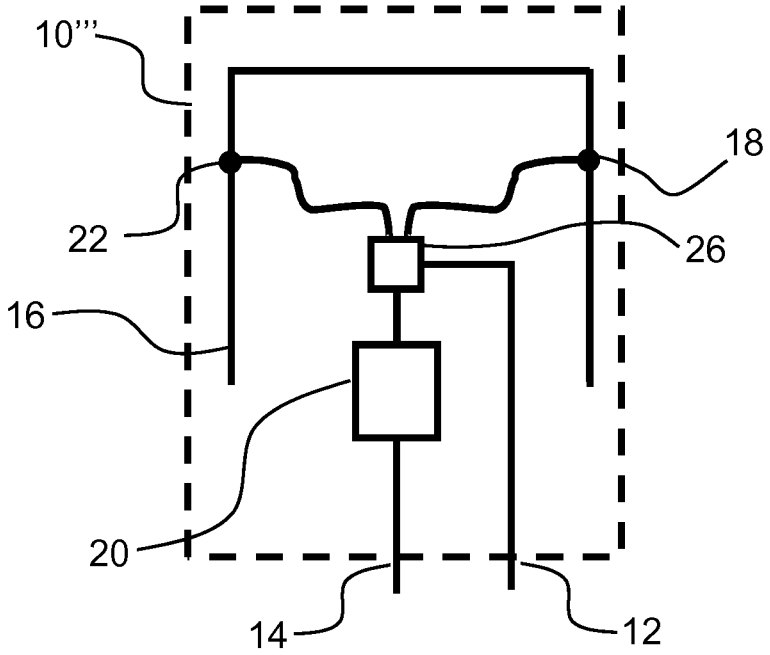

FIG. 6 illustrates an exemplary antenna system 10'" for a hearing aid 2, 2". The antenna system 10'" comprises same components as the antenna system 10" as shown in FIG. 5, but differs in the shape of the antenna 16 and the location of the first antenna feed 18 and the second antenna feed 22. The antenna 16 and the first antenna feed 18 and the second antenna feed 22 may be shaped and configured such that a first antenna configuration is adapted for a hearing aid being worn on the left ear of a user, and a second antenna configuration is adapted for a hearing aid being worn on the right ear of a user.

The location of the first antenna feed 18 may be different from the location of the second antenna feed 22. The first antenna feed 18 and/or the second antenna feed 22 are located between respective endpoints of the first antenna 16.

Figure 7:
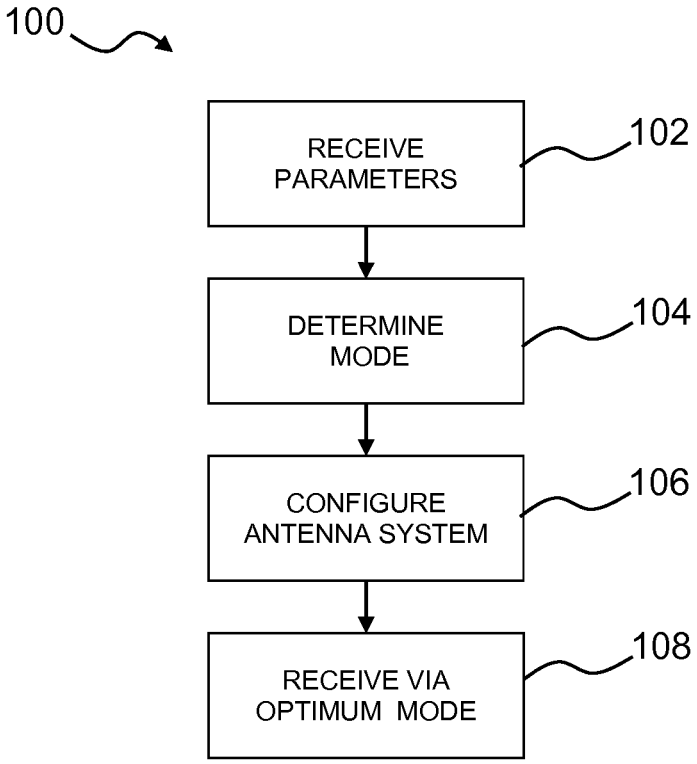

FIG. 7 illustrates a method 100 for operating a hearing aid comprising an antenna system with a data terminal for data communication. The method 100 comprises receiving parameters 102, determining an optimum antenna mode 104, configuring the antenna system 106, and receiving via the optimum antenna mode 108.

Receiving parameters 102 may comprise reception of a first parameter indicating signal quality in a first antenna mode of the antenna system. Receiving parameters 102 may comprise reception of a second parameter indicating signal quality in a second antenna mode of the antenna system.

Determining an optimum antenna mode 104 may be based on the first and/or the second parameters received in 102. The determination of the optimum antenna mode 104 may in one exemplary method be achieved by comparing signal strength of each of the antenna modes including the first and second antenna mode, and determining the optimum antenna mode as the antenna mode that provides the highest signal strength. In one or more exemplary methods, the first and second parameter may be signal-to-noise ratio or any other parameter that may be indicative of the chance of a successful reception. In one or more exemplary methods, the first and/or the second parameter may be a combination of a plurality of different parameters.

After determining the optimum antenna mode 104, the antenna system is configured to utilize the determined mode or antenna configuration 106. Hence, data is received via the optimum mode 108.

Configuration of the antenna system 106 according to the determined optimum antenna mode 104 may comprise applying a first antenna configuration to a data terminal of the antenna system, when the first antenna mode has been determined as the optimum antenna mode 104. The configuration of the antenna system 106 may further comprise applying a second antenna configuration to the data terminal of the antenna system, when the second antenna mode has been determined as the optimum antenna mode 104.

Configuration of the antenna system 106 may comprise applying a first primary impedance to a first antenna feed of the antenna system and a second primary impedance to a second antenna feed of the antenna system, when the first antenna mode has been determined as the optimum antenna mode 104. The configuration of the antenna system 106 may further comprise applying a first secondary impedance to the first antenna feed and a second secondary impedance to a second antenna feed of the antenna system, when the second antenna mode has been determined as the optimum antenna mode 104.

The determination of the optimum mode 104 may be performed by a signal processor. The signal processor may be external to the antenna system, and the signal processor may transmit a control signal to the antenna system to configure the antenna system. The signal processor may transmit the control signal to a control terminal of the antenna system.

The method 100 may be realized by the means of a hearing aid and an antenna system as described herein and in particular according to FIGS. 1-6 and the accompanying descriptions.

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

LIST OF REFERENCES

2, 2' hearing aid
4 microphone
6 signal processor
8 wireless communications unit
9 receiver
10, 10', 10", 10'" antenna system
12, 15' data terminal

14, 15 control terminal(s)
16 first antenna
16A first primary antenna section
16B first secondary antenna section
18 first antenna feed
20 antenna configurator
22 second antenna feed
24 second antenna
26 antenna switch
28 first antenna breaker
30 second antenna breaker
100 method for operating a hearing aid comprising an antenna system
102 receiving parameters, e.g. indicating signal quality of different antenna modes
104 determining an optimum antenna mode
106 configuring the antenna system to operate in the determined optimum mode
108 receiving and/or transmitting via the determined optimum antenna mode

The invention claimed is:

1. A hearing aid comprising:
a signal processor for processing one or more audio signals to compensate a hearing loss of a user of the hearing aid;
a wireless communications unit connected to the signal processor for wireless data communication; and
an antenna system with a data terminal and at least one control terminal, wherein the data terminal is connected to the wireless communications unit, the antenna system comprising a first antenna and one or more antenna feeds including a first antenna feed;
wherein the antenna system further comprises an antenna configurator for configuring the antenna system to operate in a selected antenna mode selected from a plurality of antenna modes including a first antenna mode and a second antenna mode according to a control signal transmitted on the at least one control terminal, wherein the antenna configurator is configured to apply a first antenna configuration to the data terminal when operating in the first antenna mode, and to apply a second antenna configuration to the data terminal when operating in the second antenna mode; and
wherein the first antenna configuration has a first polarization, and wherein the second antenna configuration has a second polarization different from the first polarization.

2. The hearing aid according to claim 1, wherein the one or more antenna feeds further comprises a second antenna feed, the first antenna feed is connected to the first antenna at a first position, and the second antenna feed is connected to the first antenna at a second position.

3. The hearing aid according to claim 1, wherein the first antenna feed is connected to the first antenna at a first position, and wherein the antenna system comprises a second antenna and a second antenna feed is connected to the second antenna at a second position.

4. The hearing aid according to claim 2, wherein the data terminal is connected to the first antenna feed in the first antenna mode, and the data terminal is connected to the second antenna feed in the second antenna mode.

5. The hearing aid according to claim 2, wherein the antenna configurator in the first antenna mode applies a first primary impedance to the first antenna feed and a second primary impedance to the second antenna feed, and wherein the antenna configurator in the second antenna mode applies a first secondary impedance to the first antenna feed and a second secondary impedance to the second antenna feed.

6. The hearing aid according to claim 1, wherein the signal processor is configured to select the antenna mode and transmit the control signal to the antenna system to operate the antenna system in the selected antenna mode.

7. A hearing aid comprising:
a signal processor for processing one or more audio signals to compensate a hearing loss of a user of the hearing aid;
a wireless communications unit connected to the signal processor for wireless data communication; and
an antenna system with a data terminal and at least one control terminal, wherein the data terminal is connected to the wireless communications unit, the antenna system comprising a first antenna and one or more antenna feeds including a first antenna feed;
wherein the antenna system further comprises an antenna configurator for configuring the antenna system to operate in a selected antenna mode selected from a plurality of antenna modes including a first antenna mode and a second antenna mode according to a control signal transmitted on the at least one control terminal, wherein the antenna configurator is configured to apply a first antenna configuration to the data terminal when operating in the first antenna mode, and to apply a second antenna configuration to the data terminal when operating in the second antenna mode; and
wherein the first antenna configuration has a first radiation pattern, and wherein the second antenna configuration has a second radiation pattern different from the first radiation pattern.

8. The hearing aid according to claim 1, wherein the first antenna configuration comprises an antenna section extending in a first direction, and wherein the second antenna configuration comprises an antenna section extending in a second direction substantially perpendicular to the first direction.

9. The hearing aid according to claim 1, wherein the first antenna configuration is configured for frequencies in the range of 2.4-2.5 GHz.

10. A method for operating a hearing aid comprising an antenna system with a data terminal for data communication and a control terminal for configuring the antenna system, the method comprising:
receiving a first parameter indicating a signal quality in a first antenna mode of the antenna system;
receiving a second parameter indicating a signal quality in a second antenna mode of the antenna system;
selecting an antenna mode from at least the first antenna mode and the second antenna mode based on the first and second parameters; and
configuring the antenna system using the data terminal to operate in the selected antenna mode;
wherein the act of configuring the antenna system comprises:
applying a first antenna configuration to the data terminal of the antenna system when the first antenna mode is the selected antenna mode; or
applying a second antenna configuration to the data terminal of the antenna system when the second antenna mode is the selected antenna mode;
wherein the first antenna configuration has a first polarization, and wherein the second antenna configuration has a second polarization different from the first polarization.

11. The method according to claim 10, wherein act of configuring the antenna system comprises:
applying a first primary impedance to a first antenna feed of the antenna system, and a second primary impedance to a second antenna feed of the antenna system, when the first antenna mode is the selected antenna mode; or applying a first secondary impedance to the first antenna feed of the antenna system, and a second secondary impedance to the second antenna feed of the antenna system, when the second antenna mode is the selected antenna mode.

12. The method according to claim 10, wherein the acts of receiving, the act of selecting, and the act of configuring are performed by a signal processor external to the antenna system, and wherein the method further comprises transmitting a control signal from the processor to the control terminal of the antenna system to configure the antenna system.

13. The method according to claim 10, wherein the first parameter is indicative of a received signal strength associated with the first antenna mode, and/or the second parameter is indicative of a received signal strength associated with the second antenna mode.

* * * * *